United States Patent [19]

Matsuzaka et al.

[11] Patent Number: 4,497,895

[45] Date of Patent: Feb. 5, 1985

[54] METHOD FOR PREPARING SILVER HALIDE PHOTOGRAPHIC EMULSION

[75] Inventors: Syoji Matsuzaka; Takeo Koitabashi; Yoshihiro Haga; Akio Suzuki; Hiroaki Shiozawa, all of Hino, Japan

[73] Assignee: Konishiroku Photo Industry Co., Ltd., Tokyo, Japan

[21] Appl. No.: 403,479

[22] Filed: Jul. 30, 1982

[30] Foreign Application Priority Data

Aug. 7, 1981 [JP] Japan ..... 56-123070

[51] Int. Cl.[3] ..... G03C 1/02

[52] U.S. Cl. ..... 430/569; 430/567

[58] Field of Search ..... 430/569, 567

[56] References Cited

U.S. PATENT DOCUMENTS

| | | | |
|---|---|---|---|
| 3,650,757 | 3/1972 | Irie | 430/567 |
| 3,790,387 | 2/1974 | Musliner | 430/569 |
| 3,821,002 | 6/1974 | Culhane et al. | 430/569 |
| 4,067,739 | 1/1978 | Lewis | 430/567 |
| 4,242,445 | 12/1980 | Saito | 430/569 |
| 4,298,683 | 11/1981 | Becker et al. | 430/569 |
| 4,309,501 | 1/1982 | Huguenard et al. | 430/569 |

FOREIGN PATENT DOCUMENTS

| | | | |
|---|---|---|---|
| 1335925 | 10/1973 | United Kingdom | 430/569 |
| 239033 | 3/1969 | U.S.S.R. | 430/569 |

OTHER PUBLICATIONS

Claes et al., "Quantitative Kinetic Study of Crystal Growth" I *Photo Korr* 101, pp. 37–42, 1965.

Claes et al., "Quantitative Kinetic Study of Crystal Growth" II *Photo Korr* 102, pp. 90–95, 1966.

*Primary Examiner*—Mary F. Downey

*Attorney, Agent, or Firm*—Frishauf, Holtz, Goodman & Woodward

[57] ABSTRACT

There is disclosed a method for preparing a silver halide photographic emulsion by use of an ammoniacal silver nitrate solution in a double-jet manner, characterized in that the method comprises the step of maintaining the ratio between the maximum and minimum solubility of the silver halide in a silver halide photographic emulsion at 3 or less after 1/10 of the total amount of the solution containing silver halide has been used.

The method according to the present invention provides a monodispersed silver halide photographic emulsion which has a high sensitivity, i.e., which comprises silver halide having a relatively large crystal size.

12 Claims, No Drawings

METHOD FOR PREPARING SILVER HALIDE PHOTOGRAPHIC EMULSION

The present invention relates to a method for preparing a monodispersed silver halide photographic emulsion, more particularly to a method for preparing a monodispersed silver halide photographic emulsion in which ammonia is employed as a solvent for silver halide.

The monodispersed silver halide photographic emulsion mentioned above is defined as an emulsion in which silver halide crystals constituting the emulsion itself have a noticeably narrow size distribution, and which have also uniform physical properties and photographic characteristics in addition to the narrow size distribution. Thus, a monodispersed emulsion is preferable in view of photographic performance.

A variety of methods for preparing a monodispersed silver halide photographic emulsion are known. Such techniques are disclosed in, for example, Japanese Patent Publication No. 36896/1973, Japanese Provisional Patent Publication Nos. 48521/1979, 99419/1979 and 77737/1980, and so forth.

Generally, in a manufacturing method for a monodispersed silver halide photographic emulsion, when the preparation of a silver halide crystal having a large crystal size is intended, a great deal of time is required in a crystal growth process, which is commercially impractical. For this reason, it is difficult to commercially manufacture a monodispersed silver halide photographic emulsion which has a high sensitivity, i.e. a large crystal size.

Heretofore, as a method for obtaining a silver halide having a large crystal size in a short period of time, there is known a technique of using ammonia as a solvent for the silver halide. However, the prior art technique has not been suitable for the manufacture of the monodispersed emulsion because of the following disadvantages:

(1) Due to a high pH value, the level of photographic fog is high.

(2) Owing to the employment of ammonia in the form of a silver-ammine complex, the concentration of the ammonia increases noticeably during a crystal growth process and thus the crystal size distribution of a silver halide becomes extensive by the Ostwald ripening.

Since the method of using ammonia as a solvent for a silver halide has such disadvantages as mentioned above, a solvent other than ammonia has been employed in a general preparation of the monodispersed emulsion. For example, there are methods of adopting, as a solvent for a silver halide, an organic thioether as in Japanese Patent Publication No. 11386/1972, and a thiourea derivative, an imidazole derivative and the like as in Japanese Provisional Patent Publications Nos. 82408/1978, 144319/1978 and 77737/1980, and U.S. Pat. No. 4,221,863.

However, the organic thioethers tend to bring about the photographic fog of a photographic emulsion, and allow a chemical ripening to progress in the crystal growth process of a silver halide, which fact leads to the disadvantage that the chemical ripening process subsequent to the crystalization of the silver halide photographic emulsion is hard to control. Further, sulfur-containing impurities which have a bad effect on photographic performance is liable to be contained in synthesizing the organic thioether, therefore it is necessary to severely design a refining process, and thus the employment of the organic thioether is commercially disadvantageous.

Furthermore, since the thiourea derivative and imidazole derivative above are only slightly soluble in water when they are in the form of complexes with silver ions, and since when they are added in large amounts, their complexes with silver ions precipitate, the derivatives to be added are limited to a relatively small amount, and as a result it is impossible to obtain satisfactory solvent effects. Moreover, the resulting complexes are largely adsorbed on the surface of a silver halide crystal and are easily contained in a finished emulsion. Each derivative mentioned above, if finally contained in a finished emulsion in the form of a complex, functions as an inhibitor, which is disadvantageous for photographic performance.

Therefore, a primary object of the present invention is to provide a method for preparing a monodispersed silver halide photographic emulsion which has a high sensitivity, i.e., which comprises silver halide having a relatively large crystal size.

On the other hand, heretofore, in the process where an aqueous solution of a water-soluble silver salt and an aqueous solution of a water-soluble halide are added and mixed in a double-jet method and silver halide crystals are allowed to grow, when ammonia has been used as a solvent, there are produced silver nuclei which will bring about a photographic fog at the time of the crystalization of the silver halide. For example, in the method in which an aqueous silver nitrate solution and an aqueous alkali halide solution are added to a solution in a reaction vessel in which ammonia is present, there disadvantageously appears much photographic fog, even if ammonia is used in a trace amount. The cause of the occurrence of a photographic fog has not been definite yet, but it would be supposed that just when an aqueous silver salt solution is added to a reacting solution, the concentration of silver ions becomes locally high and silver oxide is consequently produced, further the oxide is reduced to form metallic silver, which causes the photographic fog.

Thus, another object of the present invention is to provide a method for preparing a monodispersed silver halide photographic emulsion having less photographic fog in accordance with a manufacturing technique for a silver halide photographic emulsion in a double-jet method.

Further, still another object of the present invention is to provide a method for preparing a high-sensitive monodispersed silver halide photographic emulsion according to which in a chemical sensitizing process subsequent to the crystalization of a silver halide emulsion, there do not exist any substances for affecting the chemical sensitization, for example, an activating substance for the photographic fog and chemical sensitization, such as a sulfur-containing compound and an inhibitor such as imidazole for inactivating the chemical sensitization by means of their adsorption onto the crystals of the silver halide.

A reduction sensitization method is known as a technique for obtaining a high-sensitive silver halide photographic emulsion, but the silver nuclei produced by the reduction sensitization are very unstable. Being present on the surface of a silver halide crystal in a photographic emulsion, silver nuclei are oxidized and decomposed by water and oxygen, and for this reason, the shelf stability of the finished photographic emulsion is poor. Further, a reduction sensitization also has a drawback of bringing about a photographic fog in being used together with gold sensitization which is generally applied to a photographic emulsion. By the reduction sensitization method referred to herein is meant the technique by which a photographic emulsion is exposed to an atmosphere of a suitable reducing agent or a low pAg condition to produce very small metallic silver nuclei, i.e. probably silver nuclei each of which comprises about two atoms, on the surface of the photographic emulsion, and the silver nuclei produced by the reduction sensitization function as hole traps at the time of exposure to remove holes formed by photolysis, whereby recombination of photoelectrons and the holes is suppressed, and the quantum efficiency for latent image formation can be improved to heighten a photographic sensitivity.

A further object of the present invention is to provide a method for preparing a reduction sensitized silver halide photographic emulsion which shows an improved shelf stability, and which does not, produce any photographic fog even by means of subsequent gold sensitization.

The present inventors have made earnest researches on the basis of many experiments and have finally found a method for industrially preparing a monodispersed silver halide photographic emulsion which can achieve the above-mentioned objects.

That is to say, the objects of the present invention are accomplished by a method for preparing a silver halide photographic emulsion by use of an ammoniacal silver nitrate solution in a double-jet manner, comprising the step of maintaining essentially constant the solubility of the silver halide in a silver halide photographic emulsion during the production of the silver halide after 10 mole % of the total silver halide has been produced, and/or during a physical-ripening process.

According to a preferred embodiment of the present invention, a pH value and/or pAg value of a silver halide emulsion is adjusted so that the above-mentioned solubility may be maintained to be essentially constant.

By the double-jet method referred to here is meant the technique by which a silver-ammine complex solution prepared by adding an equivalent or more of ammonia to an aqueous silver nitrate solution, and a solution of a readily soluble halide such as an alkali halide are simultaneously added and mixed to precipitate silver halide crystals.

In the case of using an ammoniacal silver nitrate, just when the nitrate is added, the amount of a silver-ammine complex is overwhelmingly larger and the concentration of free silver ions is much lower, as compared with the case of directly adding an aqueous silver nitrate solution, and the production of silver oxide thus becomes extremely small with the result that the metallic silver formed by the reduction of the silver oxide is also small, accordingly no photographic fog occurs.

On the other hand, the expansion of the crystal size distribution of silver halide crystals would be attributed to the Ostwald ripening. It is known that the increase in a supersaturation of reacting solution is effective to prevent the Ostwald ripening, and, for example, as described in Japanese Provisional Patent Publication No. 48521/1979, it is preferred to add an aqueous solution of a water-soluble silver salt and an aqueous solution of a water-soluble halide at an addition rate close to a critical growth rate of the silver halide crystals. However, the critical growth rate is substantially proportional to the solubility of a silver halide, and when an ammoniacal silver nitrate is used, the concentration of ammonia increases along with its addition and thus the solubility of the silver halide increases noticeably. Therefore, the addition rate must be changed taking the increase in the solubility into consideration. Further, the addition rates of the solutions must be accelerated along with the growth of the silver halide crystals, because the surface area of each crystal increases along with the growth thereof. However, if the addition rates of the solutions are suitably accelerated along with the increase in the surface area and the solubility of the crystals, the range of an addition flow rate will extend as broad as 1:50 to 1:300, therefore it is difficult to accomplish successive and accurate adjustment in such an extensive flow range on an industrial scale. Furthermore, in the case of an emulsion having a high absolute value of the solubility, the Ostwald ripening progresses more rapidly than in the case of an emulsion having a lower solubility, even though both the emulsions are under the same supersaturation. As a result, in the former emulsion, its crystal size distribution tends to become extensive.

According to a double-jet method of using an ammoniacal silver nitrate solution of the present invention, a monodispersed silver halide photographic emulsion can be obtained by adjusting the flow rate of the solution within a relatively narrow flow range (1:5 to 1:25), and it is beneficially possible to industrially carry out measurement and adjustment of the flow rate within this range.

Further, in the present invention, the solubility of the silver halide in a silver halide emulsion during the crystalization of the silver halide after 10 mole % of the total silver halide crystals has been precipitated, and/or during a physical-ripening process is preferably within $1\times10^{-3}$ to $1\times10^{-6}$ mole/l, and it is also preferred that the value of the solubility is maintained to be substantially constant.

As means for maintaining the solubility of a silver halide crystal to be constant according to the present invention, there are the following (A) to (D):

(A) A means of successively adding water into a reaction vessel, or adding an aqueous silver salt solution and/or aqueous halide solution to be reacted in such diluted concentrations as to ensure that the solubility of a silver halide is substantially constant during the reaction.

(B) A means of controlling the pH of an emulsion by continuously adding an acid to keep the solubility constant. In this case the acid may all be added as a third additive to adjust the pH, or a portion of the acid may be added to a halide solution and the remaining acid may be used to adjust the pH by controlling its flow rate. In the case of means (A) above, the amount of water to be added is greater and hence it is often hard to industrially manufacture a great deal of the product. On the contrary, in the case of means (B) above, a pH value of the emulsion is lower, as compared with manner (A), at the same solubility, and the level of the photographic fog is thus lower, which is beneficial. The acids to be used are optional, but acids having no bad effect on photographic performance are preferable, especially acetic acid and sulfuric acid are preferred.

(C) A means of adding as a third or fourth additive a halide solution to the emulsion in order to adjust the pAg value and to thereby maintain the solubility to be substantially constant.

(D) A means of adjusting both of the pH and pAg values respectively by employing together means (B) and (C) mentioned above to keep the solubility substantially constant. It is particularly preferred that an acidic solution and halide solution other than the aqueous ammoniacal silver nitrate solution and halide solution constituting the emulsion are added as the third and the fourth additives to adjust the pH value and pAg value and to thereby keep the solubility substantially constant.

In the method for preparing a monodispersed silver halide photographic emulsion, a technique of using a seed emulsion and causing it to grow is known (e.g., Japanese Provisional Patent Publication No. 48521/1979), and also in the present invention, it is preferred that a seed emulsion is employed.

By the substantial constancy of the solubility in the present invention is meant that during a period of crystal growth process, exclusive of the initial period until the time when 1/10 or less of the total amount of a silver halide solution has been added, the ratio between the maximum solubility and minimum solubility is 3.0 or less. The solubility of a silver halide can be determined from the pAg and the pH values, the concentration of a formal ammonia (the total concentration of the added ammonia) and a temperature of the solution in a reaction vessel.

Of the total concentration of the silver ions and the total concentration of the halide ions in various complexes which are dissolved in a solution, either smaller concentration is defined as the solubility of a silver halide under a given ammonia concentration, pAg, pH and temperature conditions.

Each total concentration of the silver ions and halide ions can be calculated as follows:

Total concentration of the silver ions [TAg+]:

$$[TAg^+] = [Ag^+] + [Ag(NH_3)_2^+] + \sum_{n=1}^{4} [AgX_n^{-(n-1)}] \quad (1)$$

Total concentration of the halide ions [Tx−]:

$$[Tx^-] = [x^-] + \sum_{n=1}^{4} n[AgX_n^{-(n-1)}] \quad (2)$$

The symbols referred to above have the following meanings:

[Ag+]: Concentration of the Ag+ ions in a solution $$[Ag^+] = 10^{-pAg} \quad (3)$$

[x−]: Concentration of the halide ions in a solution $$[x^-] = \frac{[Ksp]}{[Ag^+]} = 10^{-(pKsp-pAg)} \quad (4)$$

Ksp: Solubility product of a silver halide $$pKsp = -\log Ksp \quad (5)$$

[Ag(NH3)2+]: Concentration of the silver ammonia complex ions $$[Ag(NH_3)_2^+] = \frac{1}{\beta}[NH_4OH]^2[Ag^+] \quad (6)$$

[NH4OH]: Concentration of the non-dissociated ammonia $$[NH_4OH] = \frac{-\frac{[OH^-]+Kb}{[OH^-]} + \sqrt{\left(\frac{[OH^-]+Kb}{[OH^-]}\right)^2 + \frac{8}{\beta}[Ag^+]C_{NH3}}}{\frac{4}{\beta}[Ag^+]} \quad (7)$$

Kb: Base dissociation constant of ammonia

[OH−]: Concentration of the OH− ions in a solution $$[OH^-] = \frac{Kw}{[H^+]} = 10^{-(pKw-pH)} \quad (8)$$

Kw: Ionic product of water $$pKw = -\log Kw \quad (9)$$

[H+]: Hydrogen ion concentration $$pH = -\log [H^+] \quad (10)$$

$C_{NH3}$: Formal concentration [mole/l] of the ammonia in a solution $$C_{NH3} = \frac{M_{NH3}}{V} \quad (11)$$

$$C_{NH3} = [NH_4OH] + [NH_4^+] + 2[Ag(NH_3)_2^+] \quad (12)$$

$M_{NH3}$: Total amount [moles] of the ammonia added to a solution

V: Volume (l) of a solution $[AgX_n^{-(n-1)}]$: Concentration of the silver halogen complex ions $$[AgX_n^{-(n-1)}] = \frac{1}{\beta_n}[Ag^+][X^-]^n \quad (13)$$

$\beta_n$: Stability constant of the silver halogen complex ions

Each equilibrium constant at any temperature can be obtained using a value of an equilibrium constant at a temperature of 25° C. and a ΔH value of each reaction on the basis of the Gibbs-Helmholtz formula.

Gibbs-Helmholtz formula:

$$pKt = -\log Kt = pK_{25} + \frac{1000 \times \Delta H \times (t-25)}{2.303 \times 1.987 \times 298.15 \times (t+273.15)} \quad (14)$$

t: Temperature (°C.)

$K_{25}$: Equilibrium constant at 25° C. $pK_{25} = -\log K_{25}$

Kt: Equilibrium constant at t°C.

ΔH: Enthalpy change (Kcal/mole) of a reaction

The equilibrium constants at 25° C. and ΔH values are shown in Table 1.

The ionic product Kw(t) of water at any temperature t°C. is obtained by the following formula:

$$pKw(t) = -\log Kw(t) = 14.6069 - 2.7266 \times 10^{-2} \times t + 3.3498 \times 10^{-5} \times t^2 \quad (15)$$

TABLE 1

Equilibrium constants at 25° C. and ΔH values

| Kinds of equilibrium constants | Equilibrium constants at 25° C. | Δ H [Kcal/mole] |
|---|---|---|
| Ksp of silver chloride | $1.585 \times 10^{-10}$ | −15.71 |
| Ksp of silver bromide | $5.012 \times 10^{-13}$ | −20.27 |
| Base dissociation constant of ammonia | $6.46 \times 10^{-6}$ | −6.2 |
| Dissociation constant of a silver ammonia complex $\beta$ | $6.31 \times 10^{-8}$ | −13.3 |
| Dissociation constant of silver chloride AgCl | $5.01 \times 10^{-4}$ | −2.7 |
| Dissociation constant of silver chloride complex $AgCl_2$ | $5.62 \times 10^{-6}$ | −3.9 |
| Dissociation constant of silver chloride complex $AgCl_3^{2-}$ | $2.00 \times 10^{-6}$ | −5.8 |
| Dissociation constant of silver chloride complex $AgCl_4^{3-}$ | $3.98 \times 10^{-6}$ | −13.9 |
| Dissociation constant of silver bromide AgBr | $3.16 \times 10^{-5}$ | −2.8 |
| Dissociation constant of silver bromide complex $AgBr_2^{3-}$ | $3.98 \times 10^{-8}$ | −10.5 |
| Dissociation constant of silver bromide complex $AgBr_3^{2-}$ | $3.16 \times 10^{-9}$ | −13 |
| Dissociation constant of silver bromide complex $AgBr_4^{3-}$ | $1.00 \times 10^{-9}$ | −16.2 |

In the method for preparing a silver halide photographic emulsion according to the present invention, a seed emulsion may further be subjected to a reduction sensitization treatment, whereupon the photographic emulsion having an improved sensitivity and an excellent shelf stability is obtained. And a gold sensitized photographic emulsion without fog can be obtained.

The reduction sensitization may be accomplished by the treatment of stirring an emulsion under a low pAg condition, i.e. a silver ripening, or by use of a suitable reducing agent such as stannic chloride, demethylamine borane, hydrazine or thiourea dioxide.

A silver halide used in the present invention may be a pure silver halide such as silver chloride, silver bromide or silver iodide, or may be a solid solution such as silver chlorobromide, silver chloroiodobromide or silver iodobromide. The composition of a silver halide may be homogeneous or scattered in each crystal. Particularly, the method of the present invention is advantageously applied to the manufacture of a monodispersed silver halide photographic emulsion having a core shell structure which comprises a shell having a limited thickness as disclosed in Japanese Patent Application No. 23396/1981.

A light-sensitive silver halide emulsion according to the present invention may be subjected to a doping treatment of using a suitable metallic salt or a metallic complex salt under or after the crystal growth process. As these salts just described, there are mentioned metallic salts and complex salts of gold, platinum, iridium, rhodium, bismuth, cadmium, copper and the like, and combinations of these salts. Further, there may be removed excessive halide produced at the time of the preparation of the emulsion according to the present invention, and nitrates, salts of ammonia and compounds, which are secondarily produced or are unnecessary. Their removal can be carried out by suitably using means such as the Nudel rinsing, dialysis or coagulation technique, which is commonly employed in a general emulsion manufacture.

Furthermore, the emulsion obtained according to the manufacturing method of the present invention can be subjected to any chemical sensitization which is applicable to a general emulsion. The chemical sensitization above may be accomplished by use of a single or combination of chemical sensitizers such as noble metal sensitizers, water-soluble gold salts, water-soluble platinum salts, water-soluble palladium salts, water-soluble rhodium salts, water-soluble iridium salts and the like; a sulfur sensitizer; a selenium sensitizer; a chemical sensitizer such as reduction sensitizers including polyamine, stannous chloride and the like. Additionally, the silver halide according to the present invention can optically be sensitized as extensive as a desired wave length range. A spectral sensitization for the emulsion according to the present invention can optionally be accomplished, for example, by use of a single or combination (e.g., supersensitization) of spectral sensitizers such as cyanine dyes or merocyanine dyes including zeromethine dye, monomethine dye, dimethine dye and trimethine dye. These sensitization techniques mentioned above, are disclosed in U.S. Pat. Nos. 2,688,545, 2,912,329, 3,397,060, 3,615,635 and 3,628,964; British Pat. Nos. 1,195,302, 1,242,588 and 1,293,862; Offenlegungsschrift (OLS) Nos. 2,030,326 and 2,121,780; and Japanese Patent Publication Nos. 4936/1968 and 14030/1969. A desired spectral sensitization technique can optionally be selected in compliance with a wavelength range in which the sensitization is to be made, a sensitivity and a use of a finished light-sensitive material.

The monodispersed silver halide emulsion obtained by the manufacturing method of the present invention may be put to use alone without altering its crystal size distribution, or may alternatively be put to use in combination with two or more monodispersed emulsions which are distinct in average crystal size. In the latter case, the additional emulsions are blended at an optional point of time after crystalization according to the present invention for the purpose of obtaining a desired gradient.

Further, the emulsion obtained by the manufacturing method of the present invention may be put to use in combination with two or more emulsions obtained by the other manufacturing method.

In regard to the silver halide crystals in a finished emulsion, it is preferred that at least 65% by weight of the total crystals are composed of the silver halide crystals directly prepared according to the present invention, and it is more preferred that almost all the crystals in the emulsion comprise the silver halide crystals directly made by the present invention.

The emulsion obtained by the manufacturing method of the present invention may include generally usable various additives depending on need. As such additives, there are mentioned, for example, stabilizers and antifoggants such as azaindenes, triazoles, tetrazoles, imidazolium salts, tetrazolium salts and polyhydroxy compounds; hardeners such as aldehyde series, aziridine series, isoxazole series, vinylsulfonic series, acryloly series, carbodiimide series, maleimide series, methanesulfonic ester series and triazine series; development accelerators such as benzyl alcohol and polyoxyethylene series compounds; image stabilizers such as chroman series, coumaran series, bisphenol series and phosphorous ester series; and lubricants such as waxes, glycerides of higher fatty acids and higher alcohol esters of higher fatty acids. Further, as a coating agent, an improver for permeability of a solution to be treated, an antifoamer and a substance for controlling various physical properties of light-sensitive materials, there can be used anionic type, cationic type, nonionic type or amphoteric type surface active agents. Effective antistatic agents include diacetylcellulose, styrene perfluoroalkyllithium maleate copolymer and an alkali salt of a reaction product between styrene maleic anhydride copolymer and p-aminobenzenesulfonic acid. As matte agents, there are mentioned, for example, methyl polymethacrylate, polystyrene and alkali-soluble polymers. Further, it is also possible to use colloidal silicon oxide. As latexes which are added to improve coating physical properties, there are mentioned acrylic esters, and copolymers between vinyl esters or the like and other monomers having ethylene groups. Moreover, as gelatin plasticizers there are mentioned for example glycerin and glycol series compounds, and as thickening agents there are mentioned for example styrene sodium maleate copolymer, alkyl vinyl ether maleate copolymers and the like.

As supports for the photosensitive materials which are manufactured by use of the emulsion prepared in the above-mentioned manner according to the present invention, there are mentioned, for example, baryta paper, polyethylene-coated paper, polypropylene synthetic paper, glass paper, polyester film of cellulose acetate, cellulose nitrate, polyvinyl acetal, polypropylene, polyethylene terephthalate or the like, and polystyrene film. A suitable support is selected from them in compliance with a use of a silver halide photographic material.

The supports may be provided with undercoatings, if desired.

The emulsion according to the present invention is effectively used for a variety of light-sensitive materials for general black and white photography, X-ray photography, color photography, infrared photography, microphotography, silver dye bleach process, reversal development and diffusion transfer process.

If it is required to provide the emulsion according to the present invention with extensive latitude characteristics, at least two monodispersed emulsions, which are different in average crystal size or sensitivity, should be mixed or applied to a base in the form of plural layers, whereby a light-sensitive material having a plentiful latitude and high covering power, i.e. high optical density can be obtained.

Further, when the emulsion according to the present invention is applied to a light-sensitive material for color photography, no special matters are required, and thus there are only used materials and techniques generally necessary for the light-sensitive material for color photography, for example, a technique of including a combination of cyan, magenta and yellow couplers into the emulsion according to the present invention which has previously been brought into a red-sensitive, green-sensitive and blue-sensitive state.

The light-sensitive material made by use of the emulsion according to the present invention may be developed in a known general manner after exposure.

A black and white developing agent is an alkali solution including hydroxybenzenes, aminophenols, aminobenzenes or the like, and it may further include sulfite, carbonate, bisulfite, bromide or iodide of an alkali metal. When a light-sensitive material for color photography is used, its color development may be accomplished in accordance with a usual color development technique. For a reversal development, a light-sensitive material is first developed with a black and white negative developing solution, is second exposed to a white light exposure or treated in a bath including a fogging agent, and is finally subjected to a color development by use of an alkali developing solution including a color developing agent. For the light-sensitive material according to the present invention, subsequent treatments are not particularly limited but used as usual without restriction, and as typical examples there are a procedure of carrying out a bleach-fix treatment after color development and, if necessary, performing washing and stabilization processing, and another procedure of separately carrying out bleaching and fixing after color development and, if necessary, performing washing and stabilization processing. Further, it is also known to treat a light-sensitive material having a small amount of a silver halide with an amplifier agent such as a peroxy hydrogen cobalt complex salt, and this treatment is also usable for the light-sensitive material according to the present invention. Additionally, these treatments mentioned above may be accomplished at an elevated temperature to accelerate them in some cases, and they may also be carried out at room temperature, or in particular cases, at a temperature below room temperature. When the accelerated treatments at a high temperature are carried out, a prehardening treatment may be employed. For a treating agent to be used, an auxiliary bath such as a neutralizing bath would be necessary in a certain case, and such an auxiliary bath can be used for the light-sensitive material in which the emulsion according to the present invention is used.

Next, the present invention is illustrated referring to the following examples, by which, however, the present invention is not limited at all.

EXAMPLE 1

A seed emulsion was prepared by use of the following eight solutions.

| | |
|---|---|
| Solution 1-A | |
| Ossein gelatin | 40 g |
| Distilled water | 4000 ml |
| 10% Aqueous ethanolic solution of sodium salt of polyisopropylene polyethyleneoxy disuccinic ester | 10 ml |
| $AgNO_3$ | 170 mg |
| 10% $H_2SO_4$ | 35 ml |
| Solution 1-B | |
| $AgNO_3$ | 23 g |
| Distilled water | made up to 1350 ml |
| Solution 1-C | |
| $AgNO_3$ | 577 g |
| Distilled water | made up to 1700 ml |
| Solution 1-D | |
| Ossein gelatin | 27 g |
| KBr | 15.6 g |
| KI | 0.44 g |
| 10% Aqueous ethanolic solution of sodium salt of polyisopropylene polyethyleneoxy disuccinic ester | 5 ml |
| 10% $H_2SO_4$ | 19 ml |
| Distilled water | made up to 1340 ml |
| Solution 1-E | |
| Ossein gelatin | 33 g |
| KBr | 396.5 g |
| KI | 11.3 g |
| 10% Aqueous ethanolic solution of sodium salt of polyisopropylene polyethyleneoxy disuccinic ester | 6 ml |
| 10% $H_2SO_4$ | 18.5 ml |
| Distilled water | made up to 1700 ml |
| Solution 1-F | |
| KBr | 20 g |
| Distilled water | 672 ml |

-continued

| | |
|---|---|
| Solution 1-G | |
| KBr | 70 g |
| Distilled water | 180 ml |
| Solution 1-H | |
| 7% Aqueous sodium carbonate solution | 208 ml |

Solutions 1-B and 1-D were added to Solution 1-A at 60° C. during a period of 29.5 minutes in a simultaneous mixing manner by use of such a stirring crystalizer as disclosed in Japanese Provisional Patent Patent Publication Nos. 92523/1982 and 92524/1982. Addition rates of the solutions were caused to increase with time and amount of the added solutions, as shown in Table 2 below. Two minutes after completion of the addition, Solutions 1-C and 1-E were further added thereto during a period of 83 minutes in the simultaneous mixing manner.

Addition rates of 1-C and 1-E were caused to increase with time as shown in Table 2. During the addition of Solutions 1-B and 1-D and the addition of Solutions 1-C and 1-E, the pAg values of Solution 1-A were controlled with Solution 1-F to 4.0 (EAg values+340 mV). The measurement of the EAg values was accomplished by use of a metallic silver electrode and a double-junction type saturated Ag/AgCl reference electrode. The addition of Solutions 1-B, 1-C, 1-D, 1-E and 1-F was carried out by use of a flow-variable type roller tube metering pump. Solution 1-G was then added three minutes after completion of the addition of Solutions 1-C and 1-E. Two minutes later, Solution 1-H was added thereto.

Afterward, washing and desalting were carried out in accordance with the following procedure: To the solution, 1010 ml of a 5% aqueous Demole N solution available from Kao Atlas Co., Ltd. and 1040 ml of a 20% aqueous magnesium sulfate solution as precipitants were added to produce a precipitate, and the precipitate was allowed to settle by keeping it resting. After decantation of the resultant supernatant, the precipitate was dispersed again by adding 7000 ml of distilled water. Added thereto then was 360 ml of a 20% aqueous magnesium sulfate solution to form a precipitate again. After the precipitate was allowed to settle, the resultant supernatant was decanted, and 500 ml of an aqueous ossein galatin solution (including 50 g of the ossein gelatin) was added thereto. The precipitate was dispersed by stirring the emulsion at 55° C. for a period of 30 minutes, and then distilled water was added to the emulsion in order to bring its total amount to 1500 ml. This emulsion will hereinafter be referred to as "EM-1". From observation through an electron microscope, it has been found that the emulsion is a high-quality monodispersed emulsion which comprises cubic crystals of 0.30 μm in edge length and in which the standard deviation of the crystal size distribution is 6.8% of the average crystal size.

TABLE 2

| Time [min] | Addition rate [ml/min] Solution 1-B | Solution 1-D | Solution 1-C | Solution 1-E |
|---|---|---|---|---|
| 0 | 10 | 9.7 | — | — |
| 3 | 10 | 9.7 | — | — |
| 5 | 15.9 | 15.4 | — | — |
| 7 | 22.7 | 22.0 | — | — |
| 10 | 36.4 | 35.3 | — | — |

TABLE 2-continued

| Time [min] | Addition rate [ml/min] Solution 1-B | Solution 1-D | Solution 1-C | Solution 1-E |
|---|---|---|---|---|
| 12.5 | 50 | 48.5 | — | — |
| 15 | 63.6 | 61.7 | — | — |
| 29.5 | 63.6 | 61.7 | — | — |
| 31.5 | — | — | 3.64 | 3.56 |
| 40 | — | — | 5.45 | 5.35 |
| 50 | — | — | 8.91 | 8.73 |
| 60 | — | — | 12.7 | 12.5 |
| 70 | — | — | 16.8 | 16.5 |
| 80 | — | — | 22.3 | 21.8 |
| 90 | — | — | 28 | 27.4 |
| 100 | — | — | 34.5 | 33.9 |
| 114.5 | — | — | 45 | 44.1 |

EXAMPLE 2

The monodispersed emulsion according to the manufacturing method of the present invention was prepared by allowing the seed Emulsion EM-1 obtained in Example 1 to grow with the aid of the following seven solutions. After 10 mole % of the total silver halide crystals had been precipitated, the solubility of the silver halide in the silver halide emulsion was kept between $2.69\times10^{-4}$ and $6.61\times10^{-4}$ mole//l (ratio=2.46) during the growth process of the silver halide.

| | |
|---|---|
| Solution 2-A | |
| Ossein gelatin | 54 g |
| Distilled water | 5426 ml |
| 10% Aqueous ethanolic solution of sodium salt of polyisopropylene polyethyleneoxy disuccinic ester | 4 ml |
| Acetic acid | 28 ml |
| $NH_4OH$ | 0.71 mole |
| Seed emulsion EM-1 | 37.5 ml |
| Solution 2-B | |
| Ossein gelatin | 45.3 g |
| KBr | 554 g |
| KI | 15.8 g |
| Distilled water | made up to 2265 ml |
| Solution 2-C | |
| Ossein gelatin | 7.7 g |
| KBr | 95.9 g |
| Distilled water | made up to 384 ml |
| Solution 2-D | |
| $AgNO_3$ | 945 g |
| Distilled water | 1130 ml |
| $NH_4OH$ | 11.67 moles |
| Distilled water | made up to 2649 ml |
| Solution 2-E | |
| KBr | 150 g |
| Distilled water | 300 ml |
| Solution 2-F | |
| 56% Aqueous acetic acid solution | 2000 ml |
| Solution 2-G | |
| KBr | 105.5 g |
| Distilled water | 211 ml |

Solutions 2-B and 2-D were added to Solution 2-A at 40° C. during a period of 63.3 minutes in a simultaneous mixing manner by use of such a stirring crystalizer as disclosed in Japanese Provisional Patent Publication Nos. 92523/1982 and 92524/1982. Addition rates of the solutions were caused to increase with time and amount of the added solutions, as shown in Table 3 below. After completion of the addition, Solutions 2-C and 2-D were continuously added thereto during a period of 4.9 minutes in the simultaneous mixing manner. During the addition of the solutions above, the pAg values of Solution 2-A were controlled with Solution 2-E to 9.0 (EAg values+41 mV). The pH values of Solution 2-A were controlled with Solution 2-F so as to decrease with time as shown in Table 3 below, and after 10 mole % of the total silver halide crystals had been precipitated, the solubility of the silver halide in Solution 2-A was kept substantially constant. The addition of Solutions 2-B, 2-C, 2-D, 2-E and 2-F was accomplished by use of a flow-variable type roller tube metering pump. In Table 3 there are shown amounts of the produced silver halide, addition rates, pH values and solubilities calculated from formulae (1) to (15), of the respective solutions with respect to lapse of time.

Two minutes after completion of the addition of Solutions 2-C and 2-D, Solution 2-G was added to the solution, and two minutes later, Solution 2-G was added to adjust the pH value of the solution to 6.0. Afterward, washing and desalting were carried out in accordance with the following procedure: To the solution, 730 ml of a 5% aqueous Demole N solution available from Kao Atlas Co., Ltd. and 553 ml of a 20% aqueous magnesium sulfate solution as precipitants were added to produce a precipitate, and the precipitate was allowed to settle by keeping it resting. After decantation of the resultant supernatant, the precipitate was dispersed again by adding 12300 ml of distilled water. Added thereto was 433 ml of a 20% aqueous magnesium sulfate solution to form a precipitate again. After the precipitate was allowed to settle, the resultant supernatant was decanted, and 800 ml of an aqueous ossein gelatin solution (including 80 g of the ossein gelatin) was added thereto. The precipitate was dispersed by stirring the solution at 40° C. for a period of 20 minutes, and then distilled water was added to the emulsion in order to bring its total amount of 2400 ml. This emulsion will hereinafter be referred to as "EM-2".

TABLE 3

| Time [min] | Amount of produced silver halide (final amount is taken as 100) | Addition rate [ml/min] Solution 2-D | Solution 2-B | Solution 2-C | pH | Solubility [mole/l] |
|---|---|---|---|---|---|---|
| 0 | 0 | 3.89 | 3.77 | — | 9.00 | $1.10 \times 10^{-4}$ |
| 9.9 | 2 | 7.3 | 7.08 | — | 8.98 | $1.48 \times 10^{-4}$ |
| 18.3 | 5 | 12.3 | 12.1 | — | 8.95 | $2.09 \times 10^{-4}$ |
| 26.6 | 10 | 20.7 | 20.1 | — | 8.89 | $3.16 \times 10^{-4}$ |
| 32.9 | 16 | 30.6 | 29.7 | — | 8.83 | $4.37 \times 10^{-4}$ |
| 38.1 | 23 | 41.5 | 40.3 | — | 8.76 | $5.50 \times 10^{-4}$ |
| 44.2 | 34 | 54.6 | 53.0 | — | 8.64 | $6.46 \times 10^{-4}$ |
| 49.1 | 45 | 65.0 | 63.1 | — | 8.52 | $6.61 \times 10^{-4}$ |
| 53.9 | 58 | 74.1 | 71.8 | — | 8.39 | $6.03 \times 10^{-4}$ |
| 58.9 | 72 | 78.3 | 76.0 | — | 8.24 | $4.67 \times 10^{-4}$ |
| 61.3 | 79 | 78.1 | 75.8 | — | 8.16 | $3.98 \times 10^{-4}$ |
| 63.3 | 85 | 77.2 | 74.9 | 74.9 | 8.10 | $3.39 \times 10^{-4}$ |
| 65.4 | 91 | 77.9 | — | 75.6 | 8.06 | $3.16 \times 10^{-4}$ |
| 68.2 | 100 | 78.1 | — | 75.8 | 8.00 | $2.69 \times 10^{-4}$ |

EXAMPLE 3

The seen Emulsion EM-1 obtained in Example 1 was allowed to grow by use of the same seven solutions as shown in Example 2 except that Solution 2-A is replaced with the following Solution 3-A. The same procedure as in Example 2 was employed for the growth process except the transitions of the addition rates of the added solutions and the pH values. However, after 10 mole % of the total silver halide crystals had been precipitated, the solubility of the silver halide in the silver halide emulsion was maintained between $1.10\times10^{-3}$ and $2.51\times10^{-3}$ mole/l (ratio=2.28) during the growth process of the silver halide. In Table 4 there are exhibited the addition rates of the added solutions, the pH values and the solubilities of the emulsion. This emulsion will hereinafter be referred to as "EM-3".

| Solution 3-A | | |
|---|---|---|
| Ossein gelatin | 54 | g |
| Distilled water | 5426 | ml |
| 10% Aqueous ethanolic solution of sodium salt of polyisopropylene polyethyleneoxy disuccinic ester | 4 | ml |
| Acetic acid | 28 | ml |
| $NH_4OH$ | 1.065 | moles |
| Seed emulsion EM-1 | 37.5 | ml |

TABLE 4

| Time [min] | Amount of produced silver halide (final Amount is taken as 100) | Addition rate [ml/min] Solution 2-D | Solution 2-B | Solution 2-C | pH | Solubility [mole/l] |
|---|---|---|---|---|---|---|
| 0 | 0 | 7.35 | 7.13 | — | 11.00 | $4.79 \times 10^{-4}$ |
| 7.3 | 3 | 15.33 | 14.87 | — | 10.97 | $6.46 \times 10^{-4}$ |
| 12.2 | 6.5 | 23.00 | 22.31 | — | 10.93 | $8.71 \times 10^{-4}$ |
| 15.7 | 10 | 30.13 | 29.23 | — | 10.89 | $1.10 \times 10^{-3}$ |
| 22.3 | 19.6 | 48.14 | 46.70 | — | 10.79 | $1.78 \times 10^{-3}$ |
| 27.6 | 30.7 | 62.57 | 60.69 | — | 10.66 | $2.51 \times 10^{-3}$ |
| 32.9 | 44.7 | 78.54 | 76.18 | — | 10.41 | $2.51 \times 10^{31\ 3}$ |
| 36.8 | 57.3 | 91.39 | 88.65 | — | 10.19 | $2.51 \times 10^{-3}$ |
| 44.0 | 85.4 | 117.1 | 113.6 | 113.6 | 9.70 | $2.51 \times 10^{-3}$ |
| 45.4 | 92.0 | 122.6 | — | 118.9 | 9.65 | $2.51 \times 10^{-3}$ |
| 47.1 | 100.0 | 129.3 | — | 125.4 | 9.60 | $2.51 \times 10^{-3}$ |

EXAMPLE 4

The seed Emulsion EM-1 obtained in Example 1 was allowed to grow by use of the same seven solutions and in the same manner as shown in Example 2 except the transitions of the addition rates of the added solutions and the pH values. However, after 10 mole % of the total silver halide crystals had been precipitated, the solubility of the silver halide in the silver halide emulsion was maintained between $7.08\times10^{-4}$ and $2.51\times10^{-3}$ mole/l (ratio=3.55) during the growth process of the silver halide. In Table 5 there are exhibited the addition rates of the added solution, the pH values and the solubilities of the emulsion. This emulsion will hereinafter be referred to as "EM-4".

TABLE 5

| Time [min] | Amount of produced silver halide (final amount is taken as 100) | Addition Rate [ml/min] Solution 2-D | Solution 2-B | Solution 2-C | pH | Solubility [mole/l] |
|---|---|---|---|---|---|---|
| 0 | 0 | 5.14 | 4.99 | — | 11.00 | $2.14 \times 10^{-4}$ |
| 6.0 | 1.5 | 8.58 | 8.32 | — | 11.00 | $2.75 \times 10^{-4}$ |
| 12.0 | 4.0 | 14.28 | 13.85 | — | 11.00 | $3.89 \times 10^{-4}$ |
| 16.6 | 7.0 | 21.39 | 20.75 | — | 11.00 | $5.37 \times 10^{-4}$ |
| 19.8 | 10.0 | 27.48 | 26.66 | — | 11.00 | $7.08 \times 10^{-4}$ |
| 24.7 | 16.1 | 38.80 | 37.64 | — | 11.00 | $1.07 \times 10^{-3}$ |
| 29.6 | 24.6 | 54.10 | 52.48 | — | 11.00 | $1.66 \times 10^{-3}$ |
| 34.8 | 36.7 | 69.67 | 67.58 | — | 11.00 | $2.51 \times 10^{-3}$ |
| 39.3 | 49.7 | 83.81 | 81.30 | — | 11.00 | $2.51 \times 10^{-3}$ |
| 44.5 | 67.8 | 101.5 | 98.46 | — | 11.00 | $2.51 \times 10^{-3}$ |
| 48.7 | 85.4 | 117.1 | 113.6 | 113.6 | 11.00 | $2.51 \times 10^{-3}$ |
| 50.3 | 92.5 | 123.1 | — | 119.4 | 11.00 | $2.51 \times 10^{-3}$ |
| 51.8 | 100.0 | 129.3 | — | 125.4 | 11.00 | $2.51 \times 10^{-3}$ |

EXAMPLE 5

The seed Emulsion EM-1 obtained in Example 1 was allowed to grow by use of the same seven solutions and in the same manner as shown in Example 2 except the transitions of the addition rates of the added solutions and the pH values. However, after 10 mole % of the total silver halide crystals had been precipitated, the solubility of the silver halide in the silver halide emulsion was maintained between $3.63\times10^{-4}$ and $2.51\times10^{-3}$ mole/l (ratio=6.91) during the growth process of the silver halide. In Table 6 below, there are exhibited the addition rates of the added solutions, and the transitions of the pH values as well as the solubilities of the emulsion. This emulsion will hereinafter be referred to as "EM-5".

TABLE 6

| Time [min] | Amount of produced silver halide (final amount is taken as 100) | Addition rate [ml/min] Solution 2-D | Solution 2-B | Solution 2-C | pH | Solubility [mole/l] |
|---|---|---|---|---|---|---|
| 0 | 0 | 3.89 | 3.77 | — | 9.00 | $1.10\times10^{-4}$ |
| 9.9 | 2.0 | 7.38 | 7.16 | — | 9.00 | $1.55\times10^{-4}$ |
| 19.1 | 5.5 | 13.56 | 13.15 | — | 9.00 | $2.40\times10^{-4}$ |
| 26.0 | 10.0 | 21.98 | 21.32 | — | 9.00 | $3.63\times10^{-4}$ |
| 32.2 | 16.6 | 34.78 | 33.74 | — | 9.00 | $5.75\times10^{-4}$ |
| 37.5 | 24.6 | 47.41 | 45.99 | — | 9.00 | $8.51\times10^{-4}$ |
| 41.9 | 33.7 | 61.01 | 59.18 | — | 9.00 | $1.17\times10^{-3}$ |
| 46.5 | 45.7 | 78.28 | 75.93 | — | 9.00 | $1.62\times10^{-3}$ |
| 51.1 | 60.8 | 94.81 | 91.97 | — | 9.00 | $2.19\times10^{-3}$ |
| 57.3 | 85.4 | 117.1 | 113.6 | 113.6 | 9.00 | $2.51\times10^{-3}$ |
| 58.8 | 92.5 | 123.1 | — | 119.4 | 9.00 | $2.51\times10^{-3}$ |
| 60.3 | 100.0 | 129.3 | — | 125.4 | 9.00 | $2.51\times10^{-3}$ |

EXAMPLE 6

The seed emulsion obtained in Example 1 was allowed to grow by use of the following seven solutions in a manner of using no ammoniacal silver halide to produce a monodispersed emulsion. The solubility of the silver halide during the production of the silver halide was kept constant at $1.10\times10^{-4}$.

| | |
|---|---|
| Solution 6-A | |
| Ossein gelatin | 54 g |
| Distilled water | 5426 ml |
| 10% Aqueous ethanolic solution of sodium salt of polyisopropylene polyethyleneoxy disuccinic ester | 4 ml |
| $NH_4OH$ | 0.71 mole |
| Acetic acid | 28 ml |
| Seed emulsion EM-1 | 37.5 ml |
| Solution 6-B | |
| Ossein gelatin | 45.3 g |
| KBr | 554 g |
| KI | 15.8 g |
| $NH_4OH$ | 0.906 mole |
| Distilled water | made up to 2265 ml |
| Solution 6-C | |
| Ossein gelatin | 7.7 g |
| KBr | 95.9 g |
| $NH_4OH$ | 0.154 mole |
| Distilled water | made up to 384 ml |
| Solution 6-D | |
| $AgNO_3$ | 945 g |
| Distilled water | made up to 2649 ml |
| Solution 6-E | |
| The same as Solution 2-E | |
| Solution 6-F | |
| The same as Solution 2-F | |
| Solution 6-G | |

-continued

| |
|---|
| The same as Solution 2-G |

Solutions 6-B and 6-D were added to Solution 6-A at 40° C. in the simultaneous mixing manner by use of the same stirring crystalizer as in Example 2. The addition rates of these solutions were caused to increase with time and amount of the added solutions, as shown in Table 7 below. After completion of the addition, Solutions 6-C and 6-D were continuously added thereto in the simultaneous mixing manner to produce an emulsion. During the addition of the respective solutions, the pAg values of Solution 6-A were controlled to 9.0 (EAg values+41 mV) by use of solution 6-E, and the pH values of Solution 6-A were controlled at 9.0 with Solution 6-F. Table 7 exhibits the addition rates of the added solutions and the transitions of the pH values as well as the solubilities of the emulsion.

Two minutes after completion of the addition of Solutions 6-C and 6-D, Solution 6-G was added thereto, and two minutes later, Solution 6-G was added to adjust the pH value of the emulsion to 6.0. And then a desalting treatment was carried out in the same manner as in Example 2. This emulsion will hereinafter be referred to as "EM-6".

TABLE 7

| Time [min] | Amount of produced silver halide (final amount is taken as 100) | Addition rate [ml/min] Solution 2-D | Solution 2-B | Solution 2-C | pH | Solubility [mole/l] |
|---|---|---|---|---|---|---|
| 0 | 0 | 3.88 | 3.76 | — | 9.00 | $1.10\times10^{-4}$ |
| 8.3 | 1.5 | 5.88 | 5.70 | — | 9.00 | $1.10\times10^{-4}$ |
| 17.6 | 4.0 | 8.56 | 8.30 | — | 9.00 | $1.10\times10^{-4}$ |
| 25.7 | 7.0 | 11.25 | 10.91 | — | 9.00 | $1.10\times10^{-4}$ |
| 32.2 | 10.0 | 13.62 | 13.21 | — | 9.00 | $1.10\times10^{-4}$ |
| 48.0 | 20.1 | 20.32 | 19.71 | — | 9.00 | $1.10\times10^{-4}$ |
| 53.5 | 24.6 | 22.96 | 22.27 | — | 9.00 | $1.10\times10^{-4}$ |
| 62.5 | 33.2 | 27.56 | 26.73 | — | 9.00 | $1.10\times10^{-4}$ |
| 71.4 | 43.2 | 32.50 | 31.53 | — | 9.00 | $1.10\times10^{-4}$ |
| 80.1 | 54.8 | 37.73 | 36.60 | — | 9.00 | $1.10\times10^{-4}$ |
| 90.2 | 70.3 | 44.24 | 42.91 | — | 9.00 | $1.10\times10^{-4}$ |
| 98.7 | 85.4 | 50.08 | 48.58 | 48.58 | 9.00 | $1.10\times10^{-4}$ |
| 102.1 | 92.0 | 52.51 | — | 50.93 | 9.00 | $1.10\times10^{-4}$ |
| 105.9 | 100.0 | 55.42 | — | 53.76 | 9.00 | $1.10\times10^{-4}$ |

EXAMPLE 7

Emulsions EM-2 to EM-6 were measured for average crystal size and crystal size spreads by use of an electron microscope. Length of each crystal was evaluated by measuring one side of its cube. Results thus obtained are shown in Table 8 below. The results in Table 8 indicate that permits the production of an emulsion excellent in monodispersion maintaining the solubility of a silver halide substantially constant, and keeping subbstantially constant the solubility of a silver halide within the range of $1\times10^{-3}$ to $1\times10^{-6}$ mole/l also permits the production of an emulsion more excellent in monodispersion.

Next, a spreading agent, a thickening agent and a hardener were added to each of Emulsions EM-2 to EM-6, and then the emulsions were applied onto undercoated polyethylene terephthalate film bases in a conventional manner so that the amount of Ag thereon may be 50 mg/100 $cm^2$, followed by drying to prepare samples. The samples which were not exposed yet were developed with the developing solution having the following composition and were measured for photographic fogs of the used emulsions. Optical densities of the photographic fogs are shown in Table 8 below. The results in Table 8 indicates that the emulsions in which ammoniacal silver nitrate was employed had noticeably low photographic fogs and when the pH values of the emulsions were 10 or less, the levels of the photographic fogs were further noticeably dropped.

TABLE 8

| Emulsion | Growth conditions pH | Solubility* | (ratio)** | Added silver liquid | Average crystal size [μm] | Crystal*** size spread | Photographic fog of each emulsion |
|---|---|---|---|---|---|---|---|
| EM-2 | 9.00~ 8.00 | $2.69 \times 10^{-4}$~ $6.61 \times 10^{-4}$ | (2.46) | Aqueous ammoniacal silver nitrate solution | 1.21 | 6.8% | 0.00 |
| EM-3 | 11.00~ 9.60 | $1.10 \times 10^{-3}$~ $2.51 \times 10^{-3}$ | (2.28) | Aqueous ammoniacal silver nitrate solution | 1.17 | 14.5% | 0.01 |
| EM-4 | 11.00 | $2.14 \times 10^{-4}$~ $2.51 \times 10^{-3}$ | (3.55) | Aqueous ammoniacal silver nitrate solution | 1.17 | 16.2% | 0.03 |
| EM-5 | 9.00 | $3.63 \times 10^{-4}$~ $2.51 \times 10^{-3}$ | (6.91) | Aqueous ammoniacal silver nitrate solution | 1.16 | 18.5% | 0.00 |
| EM-6 | 9.00 | $1.10 \times 10^{-4}$ | (1.00) | Aqueous silver nitrate solution | 1.22 | 7.6% | 0.85 |

*Solubility subsequent to the production of 10 mole % of the total silver halide
Ratio between a maximum and minimum of the solubility subsequent to the production of 10 mole % of the total silver halide $$*\text{Crystal size spread} = \frac{\text{Standard deviation } (\mu m) \text{ of crystal diameter}}{\text{Average crystal diameter } (\mu m)} \times 100\ (\%)$$

The composition of the developing solution above is as follows:

| Developing solution | |
|---|---|
| Anhydrous sodium sulfite | 70 g |
| Hydroquinone | 10 g |
| Anhydrous boric acid | 1 g |
| Sodium carbonate monohydrate | 20 g |
| 1-Phenyl-3-pyrazolidone | 0.35 g |
| Sodium hydroxide | 5 g |
| 5-Methyl-benzotriazole | 0.05 g |
| Potassium bromide | 5 g |
| Glutaraldehyde bisulfite | 15 g |
| Glacial acetic acid | 8 g |
| Water | made up to 1 l |

The development in this example was accomplished at 35° C. for a period of 30 seconds.

EXAMPLE 8

Emulsion EM-1 was subjected to a reduction sensitization in the following procedure.

To 170 ml of Emulsion EM-1, 300 ml of pure water was added, and 32.5 ml of a 0.1N aqueous $AgNO_3$ solution was further added at 60° C. under stirring, followed 80 minutes' ripening. At the end of the ripening, 32.5 ml of a 0.1N KBr was added to prepare a reduction-sensitized seed emulsion.

In accordance with the same procedure as in Examples 2 and 5 except that the seed emulsion in Solution 2-A was replaced with the above reduction-sensitized seed emulsion having the identical mole number, reduction-sensitized emulsions were prepared. These emulsions will hereinafter be referred to as "EM-7" and "EM-8".

It was found through an electron photomicrography that Emulsions EM-7 and EM-8 had about the same average crystal sizes and crystal size spreads as in Emulsions EM-2 and EM-5.

EXAMPLE 9

Emulsions EM-2, EM-4, EM-7 and EM-8 were subjected to a gold sensitization and a sulfur sensitization treatment followed by ripening, to these emulsions, 4-hydroxy-6-methyl-1,3,3a,7-tetrazaindene was added, and then general additives such as a spreading agent, a thickening agent and a hardener were further add thereto. The finished emulsions were applied onto undercoated polyethylene terephthalate film bases in a conventional manner so that the amount of Ag thereon may be 50 mg/100 $cm^2$, followed by drying to prepare Samples 1 to 4. One group of these samples was stored in a freezer for a period of 2 days and another group thereof was stored under the conditions of a relative humidity of 80% and a temperature of 55° C. for a period of 2 days, and the sensitometry for the samples in both the groups was carried out as follows: Exposure was accomplished through an optical wedge for a period of 1/50 second by use of a light source having a color temperature of 5400° K., and the given exposure was 3.2 CMS. The development was carried out with the abovementioned developing solution. Results thus obtained are shown in Table 9 below. As understood from the results in Table 9, Emulsion EM-8 to which the present invention was not applied brought about some photographic fog by giving gold and sulfur sensitizations when the emulsion had affection of the subjected reduction sensitization therein, and under the high-temperature and high-moisture storage conditions, it assumed the increase in the photographic fog and the noticeable decrease in the sensitivity. On the contrary, Emulsion EM-7 to which the present invention was applied brought about less photographic fog by giving gold and sulfur sensitizations when the emulsion had affection of the subjected reduction sensitization therein, and under the high-temperature and high-moisture storage conditions, it assumed the less increase in the photographic fog and the less decrease in the sensitivity. Therefore, it is concluded that the present invention can satisfactorily provide Emulsion EM-7 with sensitization effects of the reduction sensitization.

TABLE 9

| Sample | EM | Storage in a freezer for 2 days | | Storage at 55° C. and RH 80% for 2 days | |
|---|---|---|---|---|---|
| | | Photographic fog | Specific sensitivity | Photographic fog | Specific sensitivity |
| 1 | EM-2 Not underwent reduction sensitization | 0.03 | 120 | 0.04 | 104 |
| 2 | EM-5 reduction sensitization | 0.04 | 100 | 0.05 | 85 |
| 3 | EM-7 Underwent reduction sensitization | 0.03 | 155 | 0.04 | 130 |
| 4 | EM-8 Underwent reduction sensitization | 0.08 | 130 | 0.19 | 85 |

We claim:

1. In a method for preparing a silver halide photographic emulsion by a double-jet process using an ammoniacal silver nitrate solution which forms silver halide, the improvement comprising maintaining the ratio between the maximum and minimum solubility of the silver halide in said silver halide photographic emulsion within the range of up to 3.0 after 1/10 of the total amount of the solution containing silver halide has been used in the process, wherein the solubility of the silver halide is maintained within the range of $1\times10^{-3}$ to $1\times10^{-6}$ mole/l.

2. The method of claim 1 wherein the maximum and minimum solubility of the silver halide is maintained in the range of up to 3.0 by a method selected from the group consisting of adjusting the pH value, adjusting the pAg value, and adjusting both the pH and pAg values of the silver halide emulsion.

3. The method of claim 2 wherein the method of maintaining the maximum and minimum solubility of the silver halide comprises adding at least one solution selected from an acid solution and a halide solution to said ammoniacal silver nitrate solution.

4. The method of claim 2 wherein the pH of said silver halide emulsion is maintained with the range of up to 10.

5. The method of claim 1 further comprising using a seed emulsion to form said silver halide photographic emulsion.

6. The method of claim 2 further comprising using a seed emulsion to form said silver halide photographic emulsion.

7. The method of claim 3 further comprising using a seed emulsion to form said silver halide photographic emulsion.

8. The method of claim 4 further comprising using a seed emulsion to form said silver halide photographic emulsion.

9. The method of claim 5 wherein said seed emulsion consists essentially of a seed emulsion which has undergone reduction sensitization.

10. The method of claim 6 wherein said seed emulsion consists essentially of a seed emulsion which has undergone reduction sensitization.

11. The method of claim 7 wherein said seed emulsion consists essentially of a seed emulsion which has undergone reduction sensitization.

12. The method of claim 8 wherein said seed emulsion consists essentially of a seed emulsion which has undergone reduction sensitization.

* * * * *